US006289634B1

(12) United States Patent
Allardyce et al.

(10) Patent No.: US 6,289,634 B1
(45) **Date of Patent: *Sep. 18, 2001**

(54) CROSSING GUARD

(75) Inventors: David Allardyce, Baton Rouge; David L. Knight, Slaughter, both of LA (US)

(73) Assignee: B & B Electromatic, Inc., Norwood, LA (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/567,809

(22) Filed: May 9, 2000

Related U.S. Application Data

(63) Continuation of application No. 09/158,858, filed on Sep. 23, 1998, now Pat. No. 6,115,963.

(51) Int. Cl.[7] ..... E01F 13/00
(52) U.S. Cl. ..... 49/49; 49/226
(58) Field of Search ..... 49/9, 34, 49, 226, 49/227, 333, 334, 396; 404/6, 9; 160/150

(56) References Cited

U.S. PATENT DOCUMENTS 611,608 * 10/1898 Compher ..... 160/150
3,096,079 * 7/1963 Winn ..... 256/24
4,844,653 * 7/1989 Dickinson ..... 404/6
4,989,835 * 2/1991 Hirsh ..... 49/34 X
6,115,963 * 9/2000 Allardyce et al. ..... 49/49

* cited by examiner

*Primary Examiner*—Jerry Redman
(74) *Attorney, Agent, or Firm*—Jones, Walker, Waechter, Poitevent, Carrere & Denegre, L.L.P.

(57) ABSTRACT

A crossing guard is disclosed which comprises an operator positioned on one side of a thoroughfare for raising and lowering an arm, a gate connected to the arm, a first lock positioned on the opposite side of the thoroughfare, a plurality of cables supported within the gate, joined together at fixed points intermediate the ends of the cables, and a first end assembly connectable with the cables and the gate at the end of the gate opposite the operator with the first end assembly engagable with the first lock. The device further comprises a second lock positioned on the side of the thoroughfare nearer said operator engagable with a second end assembly positioned on the end of the gate nearer said operator.

16 Claims, 9 Drawing Sheets

CROSSING GUARD

STATEMENT OF PRIORITY

This application is a continuation of application Ser. No. 09/158,858 filed on Sep. 23, 1998, now U.S. Pat. No. 6,115,963.

BACKGROUND OF THE INVENTION

1. Field of the Invention

This invention relates to thoroughfare crossing guards, more particularly to a crossing guard for use at bridge and railroad crossings.

2. Prior Art

Many devices have been used to prevent motorists on a thoroughfare from crossing railroad tracks or even raised bridges. Many of these devices included a cross arm connected to an operator that raises and lowers the arm. While practical, these devices can be ineffective because many motorists simply drive around or through the arm. If a motorist is not paying attention he can simply drive through the arm and into the way of an oncoming train or other danger because the arms are constructed from wood or plastic. Use of stronger materials such as steel can be impractical because of the added weight and the concerns about the safety of drivers who crash into the arm.

In the past, attempts have been made to use arms having cables attached thereto or cables positioned within a hollow arm member extending between the sides of the roadway. In U.S. Pat. No. 4,989,835 to Hirsh, a security gate for preventing terrorists from proceeding past a designated point on a thoroughfare was disclosed. Hirsh discloses an operator with an arm connected thereto. A pair of posts is located on either side of the thoroughfare. A pipe is connected at either end of the arm with cables extending between the pipes and along the arm. When the arm is lowered, the pipes fit exterior of each pair of posts with the posts acting to restrain the cables if a vehicle impacts the arm, thus restraining the vehicle. Hirsh discloses that the cables should be placed between twenty-seven and thirty-five inches above the ground.

While the prior art discloses means for stopping vehicles, the prior art devices have several drawbacks. First, because the cables are not joined together, the upper cable(s) can ride up and over the hood of a vehicle and cut through the roof, thereby injuring the passengers. The height of the cables disclosed in Hirsh emphasizes this danger. Second, Hirsh does not disclose additional energy absorbing material that will aid in stopping the vehicle before the cables begin restraining the vehicle. Third, none of the prior art devices discloses the use of ties to hold the cables in position relative to one another so that the cables remain somewhat in position relative to each other. Finally, the prior art fails to disclose the locking mechanisms used herein to lock the arm and cable ends in place.

OBJECTS OF THE INVENTION

With these considerations in mind, it is therefore an object of this invention to provide a crossing guard that safely and effectively restrains vehicles which impact the crossing guard.

It is a further object of this invention to provide a crossing guard that will prevent vehicles from passing through the crossing guard when it is in the down position.

It is a further object of this invention to provide a crossing guard that will act as a barrier and absorb the energy of a vehicle while at the same time preventing injury to the passengers of the vehicle.

These and other advantages and objects of this invention shall become apparent from the ensuing description of the invention.

SUMMARY OF THE INVENTION

A crossing guard is disclosed which comprises an operator positioned on one side of a thoroughfare for raising and lowering an arm; a gate connected to the arm; a first lock positioned on the opposite side of the thoroughfare; a plurality of cables supported within the gate, joined together at fixed points intermediate the ends of the cables; and a first end assembly connectable with the cables and the gate at the end of the gate opposite the operator with the first end assembly and positionable within the first lock. The device further comprises a second lock positioned on the side of the thoroughfare nearer the operator and positionable within with a second end assembly positioned on the end of the gate nearer said operator.

DETAILED DESCRIPTION OF PREFERRED EMBODIMENTS OF THE INVENTION

Figure 2:
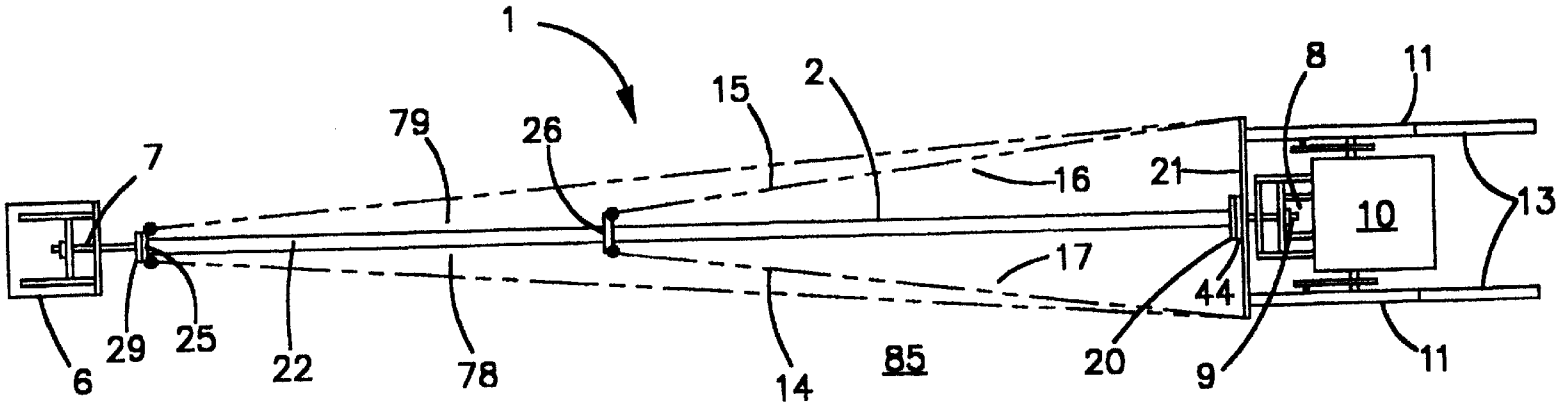
FIG. 2 is a top view of the crossing guard invention.
Figure 1:
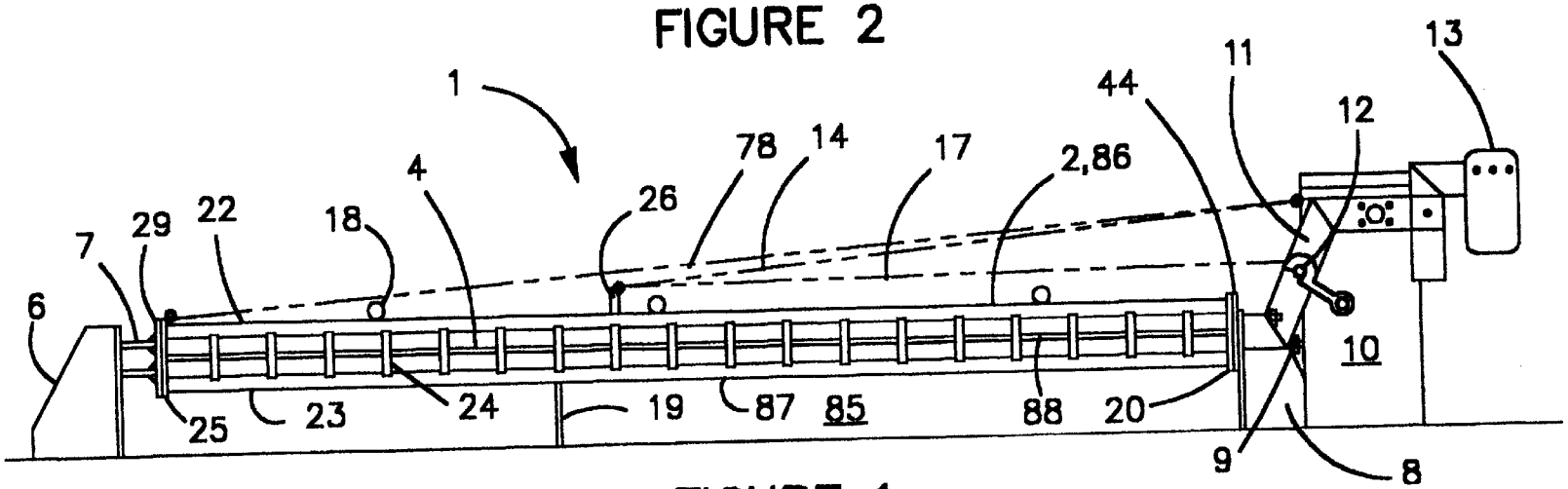
FIG. 1 is a side view of the crossing guard invention.

As shown in FIGS. 1 and 2, the crossing guard 1 generally comprises an operator 10 mounted on one side of a thoroughfare 85, the operator 10 having two alms 11 attached thereto. Crossing guard 1 is preferably positioned approximately twenty feet from the bridge opening or railroad track, although this distance can vary depending on the width and geometry of the bridge opening or railroad track. A gate 2 is attached to arms 11. Counterweights 13 allow arms 11 and gate 2 to rise and fall without the need for a very powerful operator motor. Operator 10 includes an arm lock 12 to hold arms 11 in place should gate 2 be sheared away at impact. In a preferred embodiment, counterweights 13 are of sufficient weight so that a one horsepower motor can raise and lower the gate 2.

Gate 2 comprises a support 86 which supports a plurality cables. Preferably, support 86 comprises a pair of gate members 22, 23 which are preferably hollow. Gate members 22, 23 are held apart vertically by a series of spacers 24 which arc generally placed twenty-four inches apart. Preferably the distance between the midpoints of gate member 22 and gate member 23 is approximately fourteen inches. Each gate member 22, 23 is welded at its ends to respective end plates 20, 25. Attached to end plate 25 is first end assembly 7 which engages a first lock 6 when gate 2 is in the down position as shown in FIGS. 1 and 2. In other embodiments shown in FIGS. 1, 2, 9 and 10, crossing guard I also has a second end assembly 9 which engages a second lock 8 positioned on the opposite side of thoroughfare 85. In particularly long gates, gate members 22, 23 can be constructed from one or more telescoping members. For instance, in an embodiment comprising a forty-five foot gate, the gate members 22, 23 would be constructed from a 4-inch-diameter schedule 40 aluminum gate member welded to end plate 20, a 3.5-inch-diameter schedule 40 aluminum gate member inserted partially into the 4-inch gate member and welded in place, and a 3.5 inch outside diameter gate member (ODT) inserted partially into the second gate member and welded in place. The 3.5-inch ODT is then welded to end plate 25. The material used for the gate members 22, 23 is preferably 6061 T6 aluminum. The 4 inch diameter schedule 40 aluminum gate member is approximately 23 inches long, the 3.5 inch diameter schedule 40 aluminum gate member is approximately 240 inches long, and the 3.5 inch ODT gate member is approximately 287.75 inches long. The tubes for the gate members can be obtained from Tull Metals of Baton Rouge, La. In other embodiments gate members 22, 23 could be constructed from materials such as fiberglass. When installed, gate members 22, 23 are coated with reflective material to make them more easily visible. A reflective material in sheet form could also be adhered to the gate members 22, 23. Additionally, lights 18 can be placed on gate 2 for extra visibility during the night and during times of decreased visibility.

Additional support is also provided to gate 2. A support plate 26 is attached to gate 2 approximately ⅔ down the length of the gate 2 away from operator 10. Four support wires 14, 15, 16, 17, are connected to the arms 11 and to support plate 26 and extend between them. Additionally, two support wires 78, 79 are also connected between the arms and the end of the gate 2 for more support. The support wires 78, 79 are preferably 0.25-inch stainless steel cables.

Attached to the bottom 87 of the gate 2 is a bumper rod 19 which absorbs some of the downward force when gate 2 is lowered. Bumper rod 19 helps prevent damage to gate 2 and end assemblies 7, 9 by preventing gate 2 from ramming downward into the first and second locks 6, 8.

Bumper rod 19 also provides additional vertical support to gate 2 when gate 2 is in the lowered position.

Figure 3:
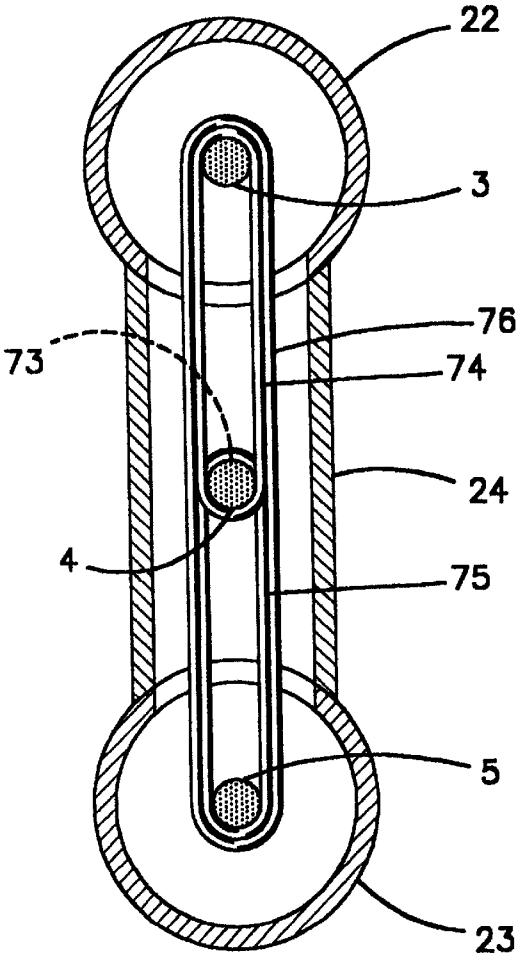
FIG. 3 is a cross sectional view of the gate of the invention taken along section line A—A of FIG. 9.

As shown in FIG. 3, cables 3, 4, 5 extend between the ends of gate 2. Preferably three cables 3, 4, 5 are used: a first cable 3 running along the upper portion of gate 2, a second cable 4 running along the middle of gate 2, and a third cable 5 running along the lower portion of gate 2. First cable 3 preferably runs coaxially within upper gate member 22 while third cable 5 runs coaxially within lower gate member 23. Spacers 24 have an aperture 73 therein allowing second cable 4 to pass therethrough. Second cable 4 preferably runs coaxially outside and between the gate members 22, 23 thorough spacers 24 via apertures 73. The ends of each cable terminate in a swage 84 (shown in FIG. 9) which is provided with a threaded exterior end 90. Each cable 3, 4, 5 is inserted into a swage 84 and held therein via crimping or other suitable means. The cables 3, 4, 5 are ¾ inch diameter stainless steel which can absorb upwards of 29,000 pounds of force and can stretch about 40% before breaking. Annealed stainless steel is preferred because it is desirable for cables 3, 4, 5 to stretch when placed under the tension caused by the impact of a vehicle against the gate 2. One may purchase ¾ inch 6×19 annealed stainless steel cable from Loos Cable Company of Pomet, Conn.

Figure 4A:
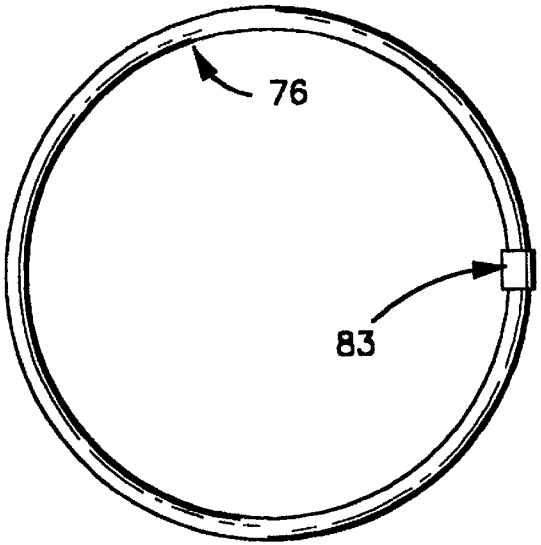
FIGS. 4*a* and 4*b* is a plain view of the cable ties.
Figure 4B:
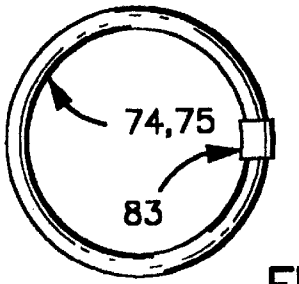

Cables 3, 4, 5 are connected together at fixed points, preferably at the locations of spacers 24. Spacers 24 are constructed to be hollow to allow communication between hollow gate members 22, 23. At each such fixed point two short cable ties 74, 75 and one long cable tic 76, as shown in FIGS. 4*a* and 4*b*, are used. Back to FIG. 3, cable tie 74 joins or wraps around a pair of cables, first cable 3 and second cable 4, while cable tie 75 joins or wraps around a pair of cables, second cable 4 with third cable 5. Cable tie 76 joins or wraps around another pair of cables, first cable 3 and third cable 5. Other joining arrangements and/or additional cables can also be used as long as the cables move and work as a unit to restrain an impacting object. For example, a single cable tie 76 around first cable 3 and third cable 5 would work, but would be less effective than using additional cable ties around additional pairs of cables.

Cable ties 74, 75, 76 are positioned within spacer 24 and are hidden from ordinary view. The relationship in size between cable ties 74, 75, 76 is shown generally in FIGS. 4*a* and 4*b*. Cable ties 74, 75, 76 are preferably constructed from either ⅜ or 5/16-inch diameter steel cable connected at each end by a swage 83. The cable ties are constructed with steel cable or other suitable material that is less resistant to stretching that the material used to construct the cables. Webbing could also be used.

When gate 2 is in the down position as shown in FIG. 1, second cable 4 preferably rests between eighteen and twenty-six inches above the ground, more preferably twenty-two inches. With second cable 4 at this height, the impact of a passenger car will be restrained primarily by third cable 5 and second cable 4. The impact of a truck or other vehicle having a height greater than a passenger car will primarily be restrained by first cable 3 and second cable 4.

Figure 5:
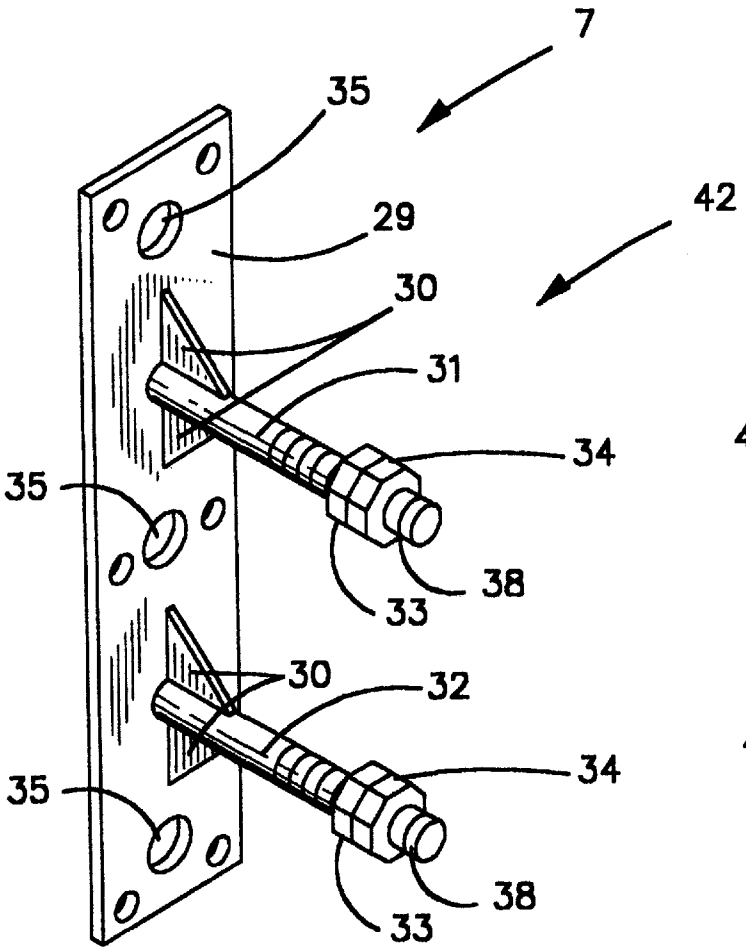
FIG. 5 is a perspective view of the first end assembly of the invention.
Figure 7A:
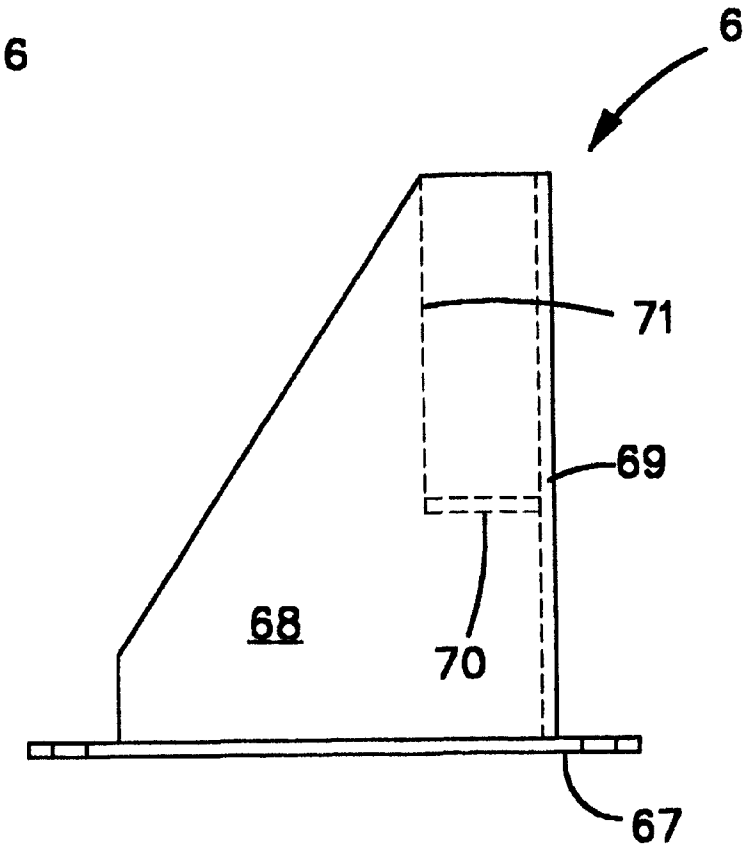
FIG. 7*a* is a side view of the first end lock of the invention.
Figure 7B:
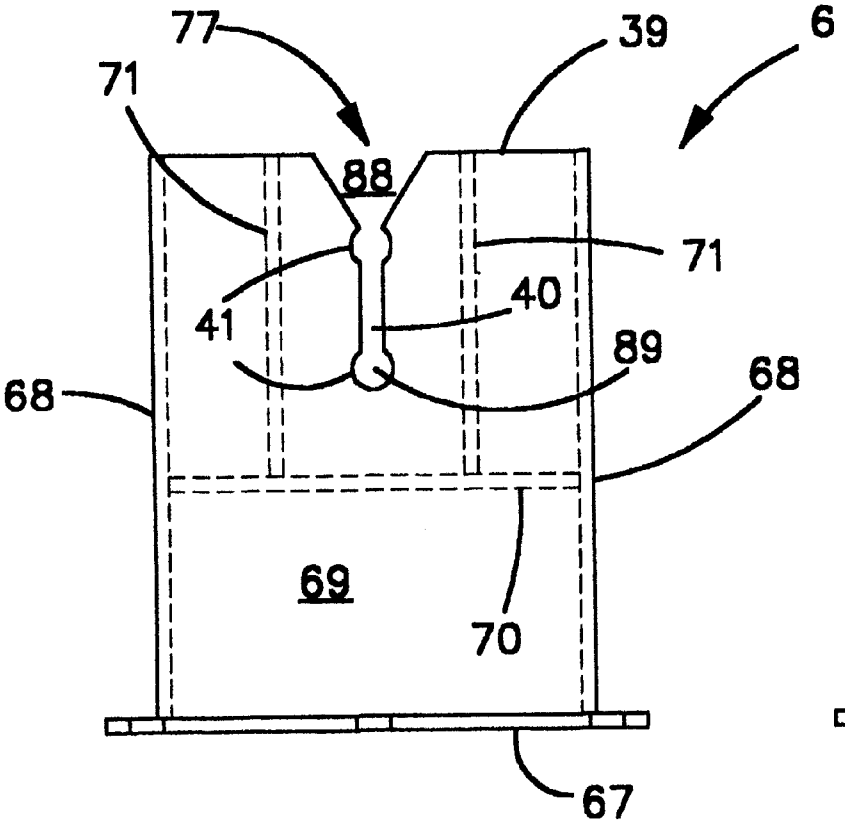
FIG. 7*b* is a front view of the first end lock of the invention.
Figure 9:
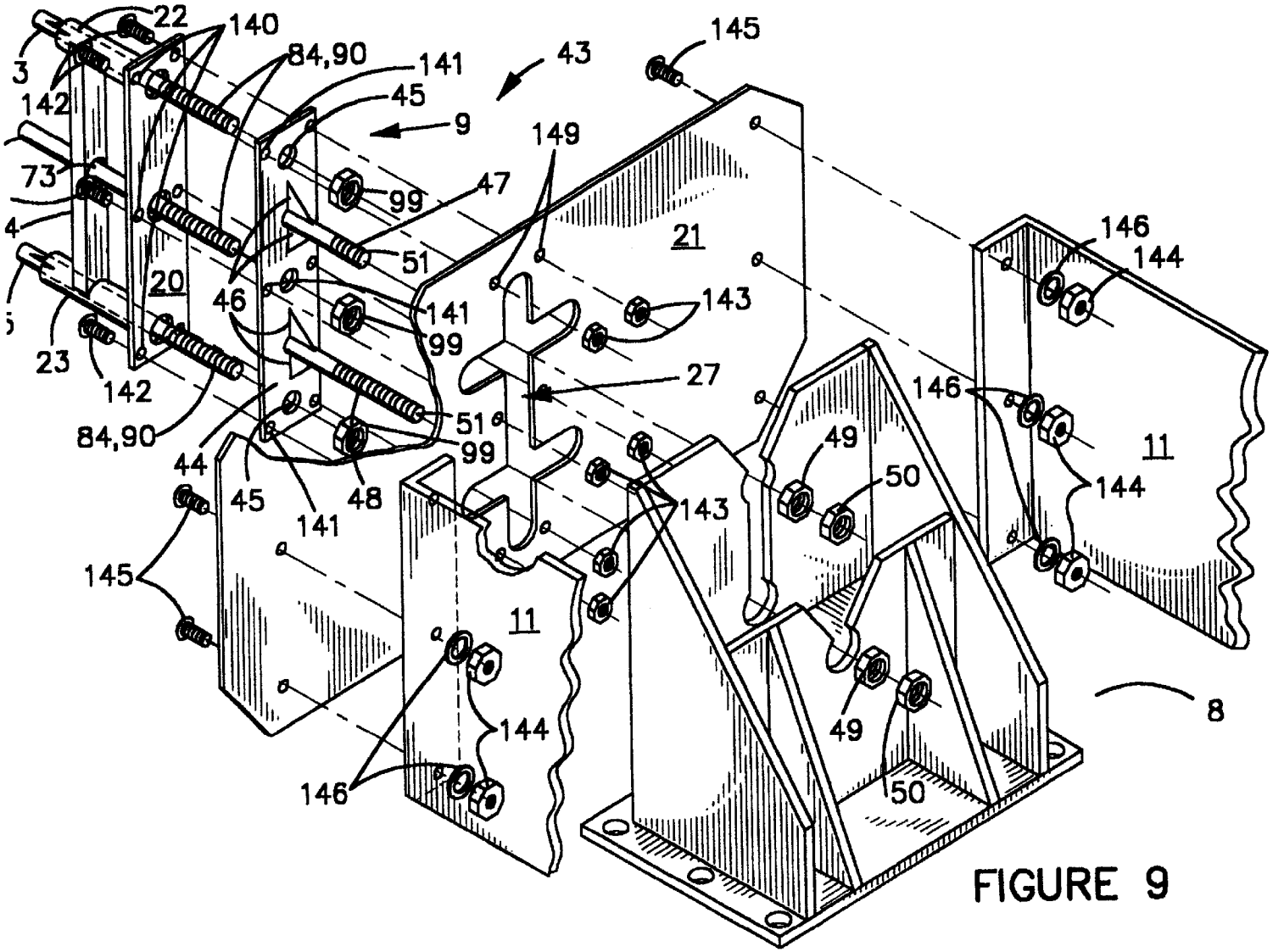
FIG. 9 is an exploded view of the interconnection between arm, gate and second end assembly of the invention.
Figure 10:
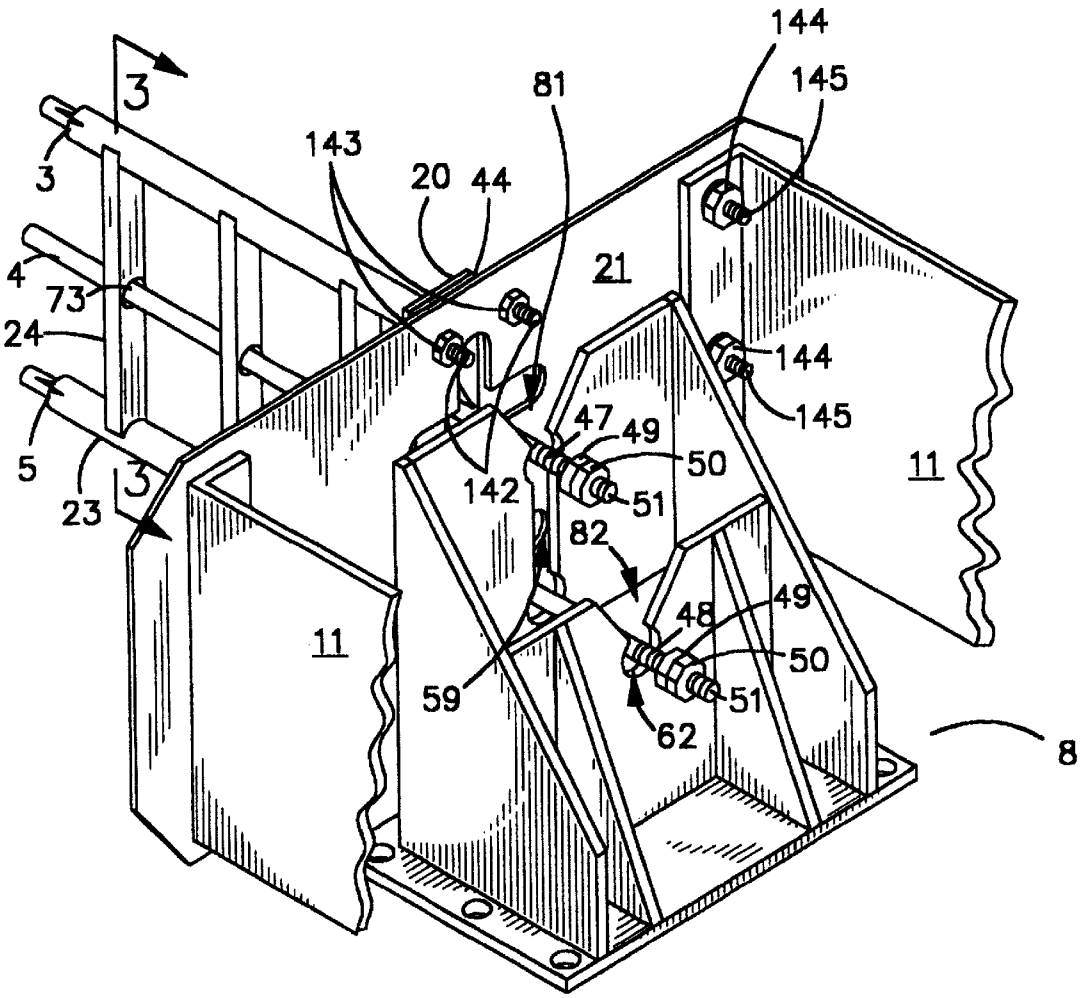
FIG. 10 is a view of the interconnection between am, gate, second end assembly and second lock of the invention shown in the down or locked position.

As shown in FIGS. 1 and 2, end plate 25 is connected to first end assembly 7; preferably it is bolted. In FIG. 5, first end assembly 7 comprises a plate 29 having two rods 31, 32 connected to and extending therefrom along the same general axis as gate 2. Other configurations, however, can be utilized. Rods 31, 32 comprise a male interlocking member 42 which engages an opposing female interlocking member 40 on first lock 6 as shown in FIG. 7*b*. Back to FIG. 5, one or more gussets 30 provide stability for rods 31, 32. Each rod 31, 32 has a threaded end 38 which threadingly engages restraining nuts 33 and lock nuts 34. Plate 29 has cable apertures 35 which allow the swages 84 of the cables 3, 4, 5 to threadingly engage and connect with plate 29 using nuts 99 as shown in FIGS. 9 and 10. Plate 29 is preferably constructed of 0.75-inch thick galvanized steel. Rods 31, 32 are preferably constructed from 1.5 inch diameter round galvanized steel rods. Fixed connections can be made by welding or other suitable means.

Crossing guard 1 further comprises a first lock 6 positioned on the side of thoroughfare 85 opposite operator 10. As shown in FIGS. 1, 7*a* and 7*b*, first lock 6 allows first end assembly 7 to engage first lock 6 vertically and prevents first end assembly 7 from disengaging first lock 6 in a substantially horizontal direction. First lock 6 includes a base plate 67 which is preferably bolted or otherwise fixedly attached onto a concrete pad (or other suitable mounting surface not shown). First lock 6 further includes opposing side plates 68 fixedly connected to locking plate 69 and base plate 67. Positioned and fixedly attached between side plates 68 and attached to locking plate 69 are side gussets 71 and support brace 70 which provide stability to first lock 6. Side gussets 71 are positioned atop support brace 70. Locking plate 69 is provided with a slot 88 which forms female interlocking member 40 running downward from upper edge 39 of plate 69 and formed to receive male interlocking member 42 (rods 31, 32). Upper portion 77 of slot 88 converges into lower portion 89 of slot 88, providing a guide for male interlocking member 42. Slot 88 is constructed with two retainer edges 41 which help prevent the male interlocking member 42 from vertically disengaging female interlocking member 40 when a vehicle crashes into gate 2.

In the preferred embodiment, the retainer edges 41 for all female interlocking members 40, 59, 62 have a diameter of 2.75 inches, the diameter being the distance from edge to edge of corresponding retainer edges on either side of a female interlocking member. Restraining nuts 33 on the male interlocking member 42 (rods 31, 32) and restraining nuts 49 on male interlocking member 43 (rods 47, 48) and have a diameter greater than 2.75 inches so that when a vehicle impacts gate 2, male interlocking member 42 will be pulled horizontally through slot 88 until retaining nuts 33 engage locking plate 69, thereby preventing male interlocking member 42 from horizontally disengaging female interlocking member 40.

Base plate 67 and locking plate 69 are preferably constricted from 1 inch galvanized steel plates, while side plate 68, gussets 71 and support brace 70 are constructed from ¾ inch galvanized steel. Fixed connections described for first lock 6 can be made by welding or other suitable means.

Figure 11:
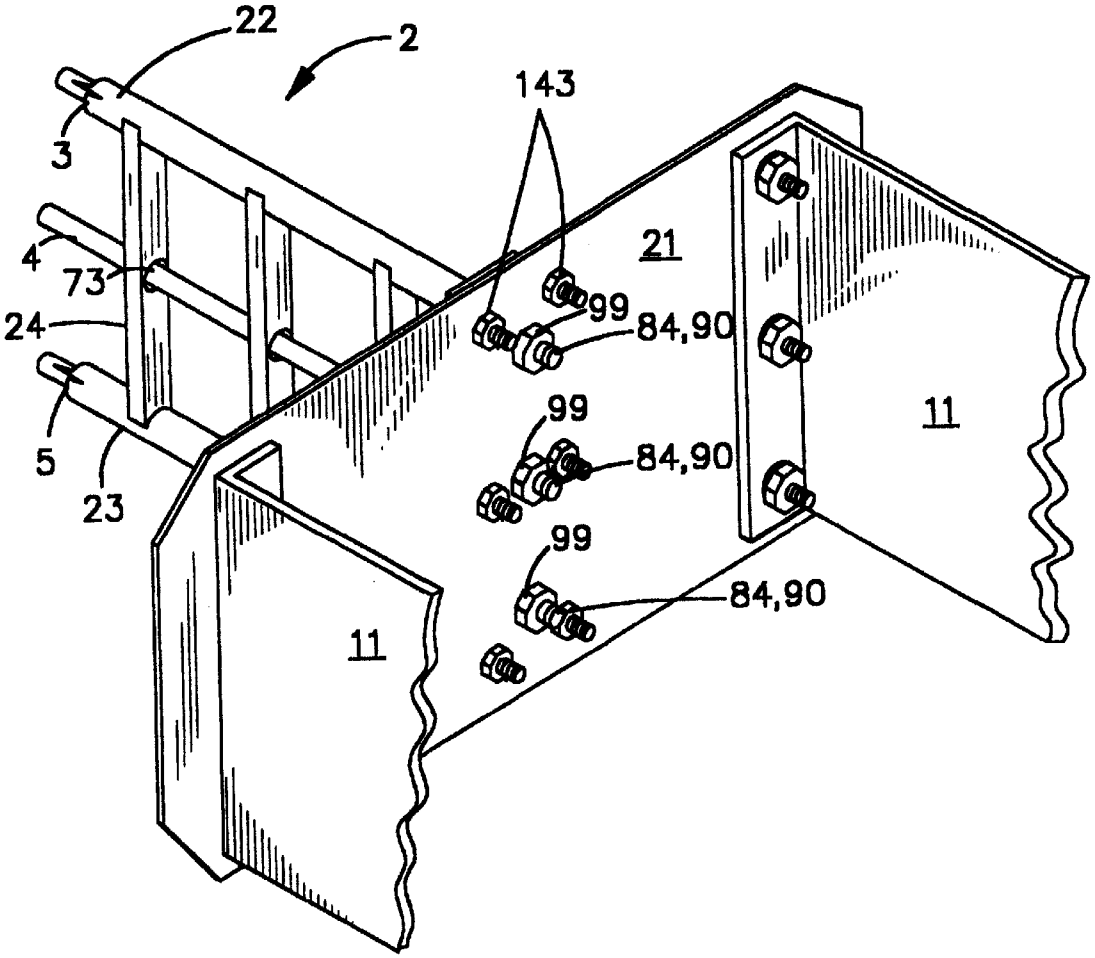
FIG. 11 is a view of the interconnection between the gate and arm in an embodiment of the invention having no second end assembly or second lock.

In the embodiments having only a first end assembly 7 and no second end assembly 9, as shown in FIG. 11, cables 3, 4, 5 extend through end plate 20, and the swages 84 are then fixedly attached to arm plate 21 using nuts 99. This arrangement provides end support to the cables 3, 4, 5 and gate 2 when gate 2 is impacted by a vehicle.

Figure 6:
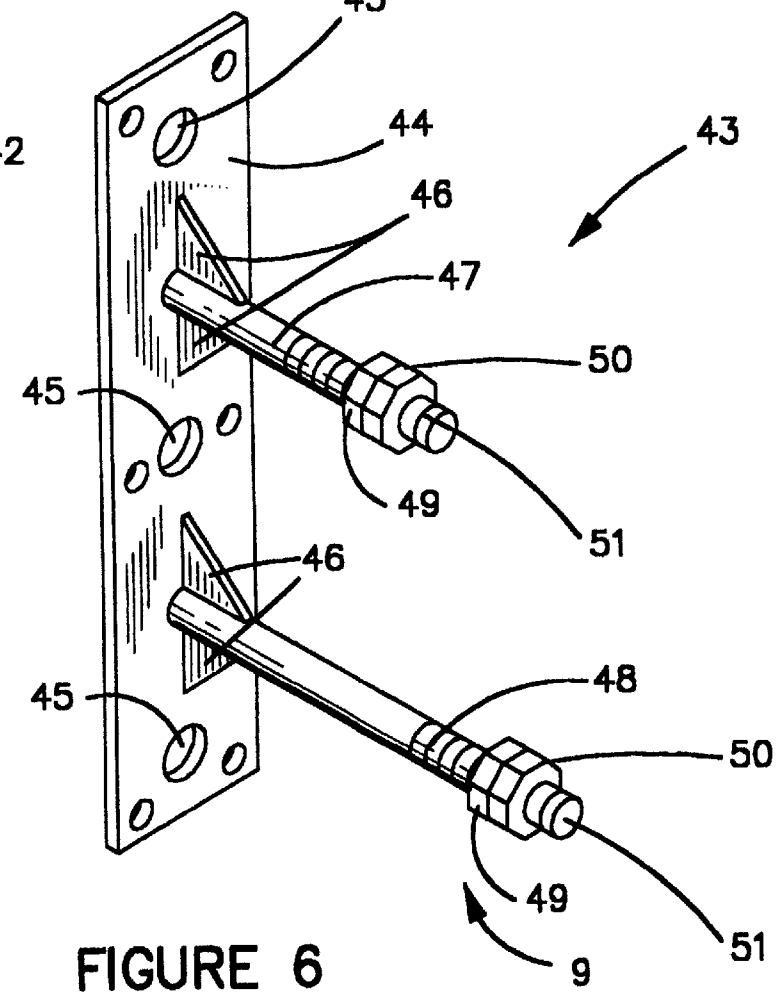
FIG. 6 is a perspective view of the second end assembly of the invention.

As shown in FIGS. 9 and 10, other embodiments of crossing guard I can also have a second end assembly 9 attached to gate 2 at its end near operator 10. Second end assembly 9 is vertically engageable with a second lock 8 positioned between thoroughfare 85 and operator 10 (see FIG. 1). As shown in FIG. 6, second end assembly 9 comprises a plate 44 having an upper rod 47 and a lower rod 48 which extend along the same general axis as gate 2. For reasons discussed below, lower rod 48 is longer than upper rod 47. Rods 47, 48 comprise a male interlocking member 43 that engages opposing female interlocking members 59, 62 on second lock 8. One or more gussets 46 provide stability to rods 47, 48. Each rod 47, 48 has a threaded end 51 which threadingly engages restraining nuts 49 and lock nuts 50. Plate 44 has cable apertures 45 which allow the swages 84 on the ends of cables 3, 4, 5 to threadingly engage and connect with plate 44 using nuts 99 as shown in FIG. 9. Plate 44 is preferably constructed with ¾ inch galvanized steel. Rods 47, 48 are preferably constructed from 1.5 inch diameter round galvanized steel rods. Construction of second end assembly 9 is similar to that of first end assembly 7.

Referring now to the area near second lock 8 as shown in FIGS. 9 and 10, arm plate 21 is bolted to ends of the arms 11 using bolts 145, washers 146 and nuts 144. Arm plate 21 has a double-T aperture 27 formed therein. As shown in FIG. 9, rods 47, 48 on second end assembly 9 are then inserted through aperture 27. End plate 20 and second end assembly 9 are then attached (through apertures 140 in end plate 20 and apertures 141 in second end assembly 9) to aim plate 21 via apertures 149 using shear bolts 142 which threadingly engage nuts 143 on the side of arm plate 21 opposite gate 2. Shear bolts 142 arc used so that they will shear away if the gate 2 is impacted by a vehicle. By using bolts that shear away, damage to the arms 11 and operator 10 is minimized during a crash. The distance that second end assembly 9 will move after shear bolts 142 are sheared away is limited by distance that the female interlocking members 59, 62 on second end lock 8 will allow the male interlocking member 43 (rods 47, 48) to move horizontally. The double T aperture 27 allows some movement of the rods 47, 48 thereby minimizing the damage to arm plate 21 when gate 2 is impacted by a vehicle.

Second lock 8 is positioned on the side of thoroughfare 85 near the operator 10. As shown in FIGS. 8*a*–8*d*, second lock 8 allows second end assembly 9 to vertically engage second lock 8 and prevent second end assembly 9 from disengaging second lock 8 in a substantially horizontal direction. Second lock 8 includes a base 66 which is preferably bolted or otherwise fixedly attached to a concrete pad or other suitable mounting surface not shown. Second lock 8 further includes opposing side braces 63 and opposing back braces 64. Front locking plate 56 is positioned vertically and is fixedly attached base 66 and side braces 63. Back locking plate 57 is positioned vertically nearer operator 10 and is fixedly attached to base 66, side braces 63 and back braces 64. Mid support 65 is fixedly attached to side braces 63, front locking plate 56 and back locking plate 57.

Figure 8C:
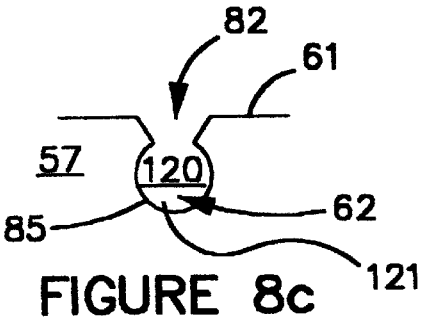
FIG. 8*c* is a close-up view of the female interlocking member in the back locking plate of the invention.
Figure 8A:
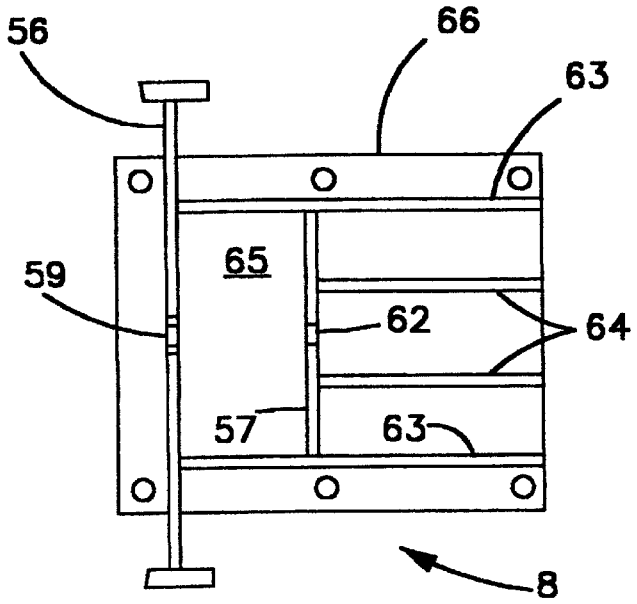
FIG. 8*a* is a top view of the second end lock of the invention.
Figure 8D:
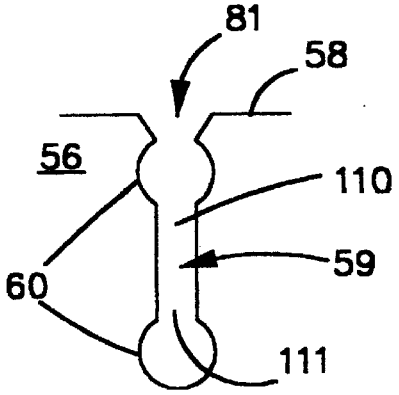
FIG. 8*d* is a close-up view of the female interlocking member in the front locking plate of the invention.
Figure 8B:
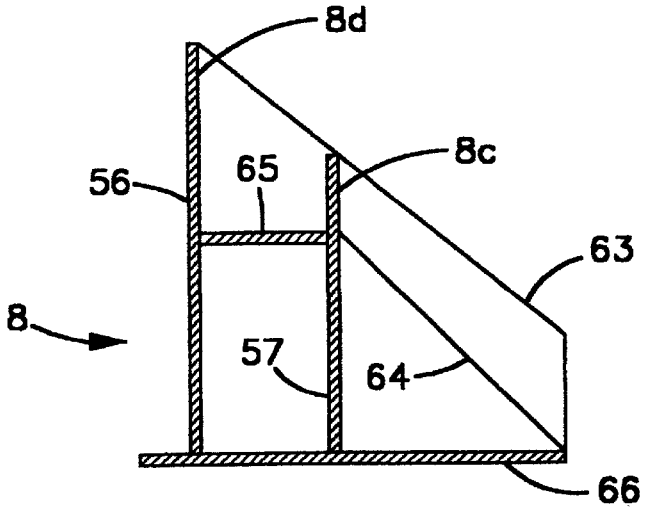
FIG. 8*b* is a side view of the second end lock of the invention.

As shown in FIG. 8*d*, front locking plate 56 is provided with a slot 110 which forms female interlocking member 59 running downward from top edge 58 of plate 56 and formed to receive male interlocking member 43 (rods 47, 48). Upper portion 81 of slot 110 converges into lower portion 111 of slot 110 providing a guide for male interlocking member 43. Slot 110 is constructed with two retainer edges 60 which help prevent male interlocking member 43 (rods 47, 48) from vertically disengaging female interlocking member 59 when a vehicle crashes into gate 2.

Back locking plate 57 is provided with a slot 120 which forms female interlocking member 62 running down from the upper edge 61 of plate 57 and formed to receive male interlocking member 43, more particularly, lower rod 48. Upper portion 82 of slot 120 converges into lower portion 121 of slot 120, providing a guide for male interlocking member 43. Slot 120 is constructed with a retaining edge 85 which helps prevent male interlocking member 43, more particularly rod 48, from vertically disengaging female interlocking member 62 when a vehicles crashes into gate 2. Restraining nuts restraining nuts 49 on male interlocking member 43 (rods 47, 48) and have a diameter greater than 2.75 inches so that when a vehicle impacts gate 2, male interlocking member 43 will be pulled horizontally through slots 110, 120 until retaining nuts 49 engage locking plates 56, 57, thereby preventing male interlocking member 43 from horizontally disengaging female interlocking member 59, 62.

Gate 2 is locked is the following manner. As gate 2 swings downward, male interlocking member 42 is lowered into slot 88 so that it becomes positioned within female interlocking member 40 on lock 6. Simultaneously, male interlocking member 43 is lowered into slots 110, 120 so that it becomes positioned within female interlocking members 59, 62 on second lock 8.

It is necessary that lower rod 48 be longer than upper rod 47 so that nuts 49, 50 avoid contact with locking plates 56, 57 during the downward motion of gate 2. As gate 2 swings downward, bolts 49, 50 on upper rod 47 fall outside plate 56 nearer back locking plate 57 as upper rod 47 falls into slot 110 and becomes positioned within female interlocking member 59. Simultaneously, lower rod 48 falls into slot 120 and becomes positioned within female interlocking member 62. The distance between locking plates 56, 57 and nuts 49, 50 on rods 47, 48 is adjusted such that if second end assembly 9 is pulled horizontally (as when a vehicle impacts the gate) through female interlocking members 59, 62, bolts 49, 50 on each rod 47, 48 will contact the respective locking plates 56, 57 simultaneously to provide the maximum resistant force during impact by a vehicle.

In another embodiment not shown, cables 3, 4, 5 could extend between the ends of the gate outside the gate members 22, 23 and be attached thereto for support at the fixed tie points by rings or other means. A single gate member 22 can also be used. The cable ties 74, 75, 76 join the cables in the same manner, but would themselves be supported by either gate members 22, 23 or the spacers 24 by rings or other means. The further construction of the crossing guard 1 would be the same as herein described.

In another embodiment not shown in the figures, the female interlocking member and the male interlocking members can be reversed so that the female interlocking member is located on the gate while the male interlocking members are located in the locks. The male and female interlocking members are designed to resist rotation of the interlocking members positioned on the gate when it is impacted by a vehicle; hence, rotation of the cables is also resisted. Consequently, other male and female interlocking member designs are possible, such as a three or four male interlocking member pattern or a pattern where the male interlocking members are aligned vertically rather than horizontally. Hence, the design of the male and female interlocking members can take on a variety of configurations.

Figure 12:
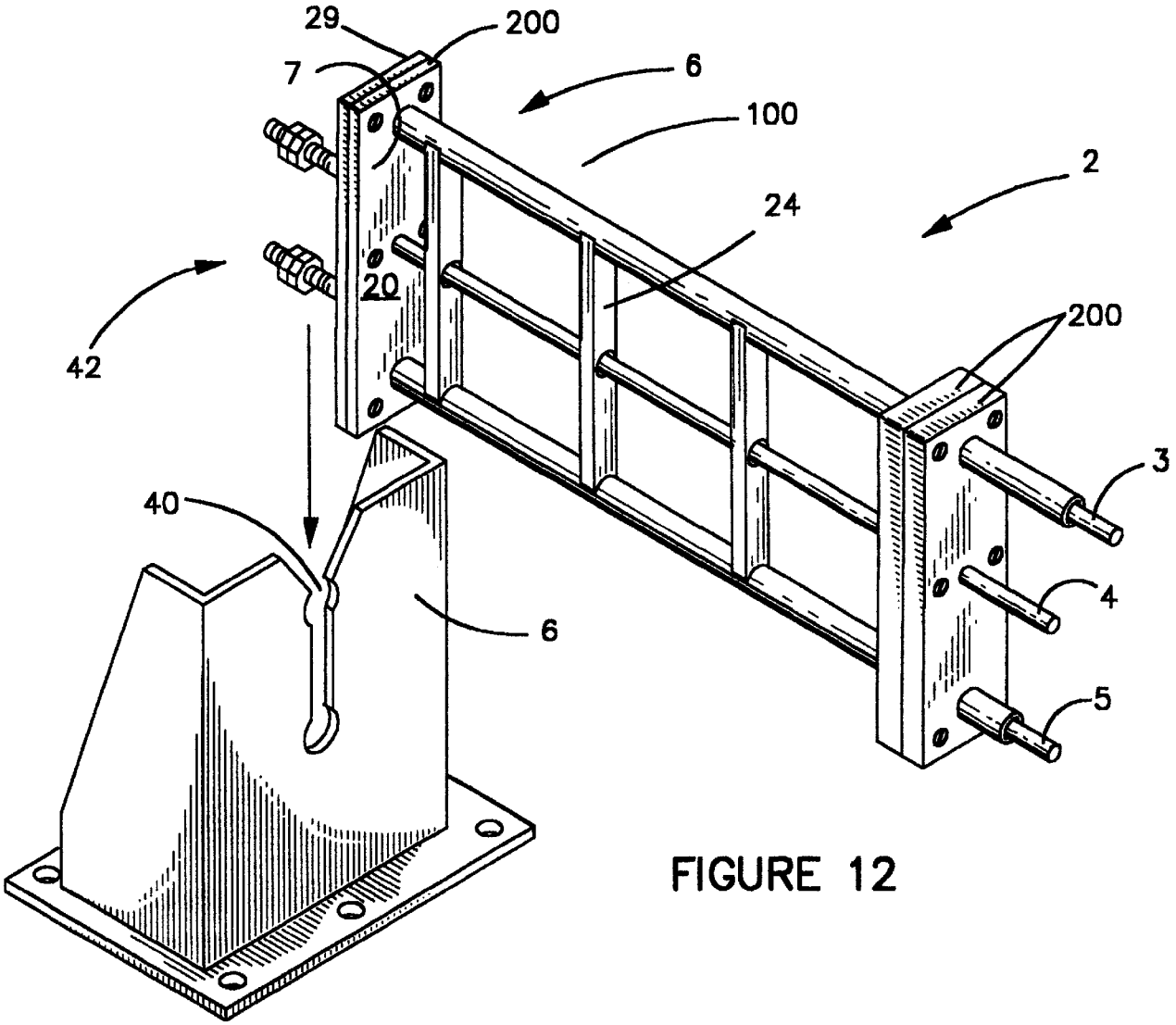
FIG. 12 is a perspective view of an embodiment of the gate with interconnecting cross members of the invention.

In another embodiment shown in FIG. 12, gate 2 can comprise a plurality of interchangeable cross members 100 which arc essentially shorter versions of gate 2 as described herein having hollow tubular members connected by spacers which support the cable ties. The hollow tubular members house the first cable 3 and third cable 5. The advantage to having a plurality of cross members 100 is that if one cross member 100 is destroyed, there is no need to replace the entire gate. Rather, the damaged cross member can be replaced. Additionally, use of a plurality of cross members 100 makes the unit easier to ship. A first cross member would be bolted at the end of gate 2 nearest operator 10 to second end assembly 9 while a last cross member would be bolted to first end assembly 7 at the opposite end of gate 2 near first lock 6. Each successive cross member would then be bolted to another cross member at plates 200 which are fixedly attached at the ends of each cross member 100. Cables 3, 4, 5 run through each cross member in a similar fashion described for a gate 2 with a single cross member. The number of cross members 100 used would be dictated by the length needed for gate 2. Preferably, cross members 100 would be constructed in five or ten foot sections.

During impact of the vehicle, the following occurs to stop vehicles from crashing through gate 2. When gate 2 is lowered, the male interlocking members 42, 43 become positioned within the respective female interlocking members 40, 59, 62 on end locks 6, 8. When the vehicle impacts gate 2, gate members 22, 23 absorb some of the impact energy before bending and/or breaking at the impact point. Shear bolts 142 connecting end plate 25 and second end assembly 9 to arm plate 21 shear off, allowing end plate 25 and second end assembly 9 to move away from arm plate 21 (through aperture 27) to prevent damage to arm plate 21 and the arms 11. As gate 2 moves along the same direction of the impacting vehicle, male interlocking members 42, 43 are pulled horizontally through the female interlocking members 40, 59, 62 until the restraining nuts 33, 49 contact the respective locking plates 56, 57, 69, thereby preventing any further horizontal movement of the end assemblies 7, 9. At this point, the cables 3, 4, 5 begin to absorb the kinetic energy of the moving vehicle. Because the cables 3, 4, 5 are joined together vertically at fixed points, the cables 3, 4, 5 along with the cable ties 74, 75, 76 begin to act as a net. The cable tics 74, 75, 76 keep the cables a fixed maximum distance apart because of their low stretch properties, thereby preventing any of the cables 3, 4, 5 from slipping under or over the impacting vehicle. Finally, the remainder of the kinetic energy of the impacting vehicle is absorbed by the stretching of the cables 3, 4, 5 until the vehicle comes to a rest before it impacts the raised buidge or passing train.

Although the preferred embodiments have been described, it will be appreciated by those skilled in the art to which the present invention pertains that modifications, changes, and improvements may be made without departing from the spirit of the invention defined by the claims.

We claim:

1. A crossing guard to block a thoroughfare comprising:

an operator positionable on one side of a thoroughfare for raising and lowering a gate;

a first end lock positionable on the side of said thoroughfare opposite said operator;

a gate having a first and a second end, said second end connectable to said operator, said first end having a first end assembly, said first end assembly adapted to engage said first end lock when said operator and said first end lock are positioned on opposite sides of a thoroughfare and said gate is lowered, said gate further having at least one support extending substantially between said first and said second ends, a plurality of spaced-apart cables extending substantially between said first and said second ends, at least one of said cables supported by said support, and at least one cable tie joining at least one pair of said plurality of cables, said at least one cable tic placed between said first and said second ends.

2. The apparatus according to claim 1 wherein said plurality of cables comprises a first, a second and a third cable.

3. The apparatus according to claim 2 wherein said pairs arc joined in a predetermined order.

4. The apparatus according to claim 3 wherein said predetermined order comprises said first cable and said third cable joined together, said first cable and said second cable joined together, and said second cable and said third cable joined together.

5. The apparatus according to claim 2 wherein said second cable is positioned between eighteen and twenty-six inches above said thoroughfare when said gate is in the lowered position.

6. The apparatus according to claim 5 wherein said second cable is positioned approximately twenty-two inches above said thoroughfare when said gate is in the lowered position.

7. The apparatus according to claim 1 further comprising a male interlocking member and a female interlocking member, one of said male or said female interlocking members positioned on said first end lock and the other of said male or said female interlocking member positioned on said first end assembly, said male and said female interlocking members adapted to interlock so that when so interlocked, said interlocked male and said female interlocking members resist disengagement from each other.

8. The apparatus according to claim 1 wherein said at least one cable tie is constructed from a material that is more resistant to stretching than said material used to construct said plurality of cables.

9. The apparatus according to claim 1 wherein said gate is constructed so that when said gate is connected to said operator, said gate will substantially disconnect from said operator when a vehicle impacts said gate.

10. The apparatus according to claim 9 wherein said gate is connectable to said operator by a plurality of shearable bolts.

11. The apparatus according to claim 1 wherein said support comprises at least one gate member.

12. The apparatus according to claim 11 wherein said support comprises a first hollow gate member and a second hollow gate member connected by spacers between said gate members.

13. The apparatus according to claim 12 having a plurality of cross members, said plurality of cross members adapted to be connected to each other, said first end assembly or a second end assembly.

14. The apparatus according to claim 12 wherein said cross members comprise a first crossbar and a second crossbar connected by spacers between said crossbars, said spacers positioned at fixed points.

15. The apparatus according to claim 1 wherein said support comprises at least one cross member.

16. The apparatus according to claim 1 wherein said cable ties are constructed from a material that is substantially unstretchable so that said cable ties and said plurality of spaced-apart cables function as a net when said gate is impacted by a vehicle.

* * * * *